US006193429B1

(12) United States Patent
Kim

(10) Patent No.: US 6,193,429 B1
(45) Date of Patent: Feb. 27, 2001

(54) TIP MECHANISM FOR KNOCK-TYPE BALLPOINT PEN

(75) Inventor: Chung-Kyung Kim, Seoul (KR)

(73) Assignee: Dong-A Pencil Co., Ltd., Seoul (KR)

( * ) Notice: Subject to any disclaimer, the term of this patent is extended or adjusted under 35 U.S.C. 154(b) by 0 days.

(21) Appl. No.: 09/394,972

(22) Filed: Sep. 13, 1999

(30) Foreign Application Priority Data

May 25, 1999 (KR) ..... 99-8991

(51) Int. Cl.[7] ..... B43K 7/12; A45D 34/04; B05C 17/02

(52) U.S. Cl. ..... 401/214; 401/216

(58) Field of Search ..... 401/214, 220, 401/216

(56) References Cited

U.S. PATENT DOCUMENTS

| | | | | |
|---|---|---|---|---|
| 554,189 | * | 2/1896 | Kochendarfer | 401/214 |
| 1,839,160 | * | 12/1931 | Nissen, Jr. | 401/214 |

FOREIGN PATENT DOCUMENTS

| | | | | |
|---|---|---|---|---|
| 967607 | * | 11/1950 | (FR) | 401/214 |
| 1071169 | * | 8/1954 | (FR) | 401/214 |
| 500193 | * | 11/1954 | (IT) | 401/214 |
| 4-06271 | | 1/1992 | (JP) . | |
| 4-25388 | | 3/1992 | (JP) . | |
| 4-53781 | | 7/1992 | (JP) . | |
| 4-53782 | | 7/1992 | (JP) . | |
| 5-47503 | | 8/1993 | (JP) . | |
| 6-279450 | | 2/1994 | (JP) . | |
| 6-187464 | | 8/1994 | (JP) . | |
| 7-020657 | | 2/1995 | (JP) . | |
| 7-055516 | | 3/1995 | (JP) . | |
| 7-098051 | | 3/1995 | (JP) . | |
| 8-209108 | | 7/1996 | (JP) . | |
| 97-25261 | | 8/1997 | (KR) . | |
| WO97/4420 | | 11/1997 | (WO) . | |

* cited by examiner

*Primary Examiner*—Charles R. Eloshway
(74) *Attorney, Agent, or Firm*—Christensen O'Connor Johnson Kindness PLLC

(57) ABSTRACT

A tip mechanism for a knock type ballpoint pen with an ink container includes a tip body having an inner ink-guide hole and top and bottom end portions. The top end portion of the tip body is fitted within the ink container. A ball receptor is formed at the bottom end portion of the tip body. A ball is disposed in the ball receptor to be rotated. The ball is partially exposed to the outside. An elastic member is inserted into the ink-guide hole of the tip body. The elastic member has a ball pressing part for pressing the ball toward the outside. The ball pressing part is formed with a curved shape. The curved shape of the ball pressing part is processed by bending the ball pressing part at a predetermined angle.

4 Claims, 6 Drawing Sheets

TIP MECHANISM FOR KNOCK-TYPE BALLPOINT PEN

BACKGROUND OF THE INVENTION (a) Field of the Invention

The present invention relates to a tip mechanism for a knock-type ballpoint pen and, more particularly, to a tip mechanism for a knock-type ballpoint pen which can perform a ball pressurizing function in an appropriate manner.

(b) Description of the Related Art

Generally, ballpoint pens make use of water gel ink or oil gel ink which has a high viscosity at a static state but has a reduced viscosity at writing with the application of shearing force through rotation of the ball. Such ballpoint pens are classified into a tip covering type of exposing a tip portion to the outside with a separate tip cover at all times and a knock type of exposing the tip portion to the outside only at writing without the separate tip cover.

The usual knock-type ballpoint pen includes a barrel-shaped case with a one-sided conical portion and an opposite sided knocking member, an ink storing tube disposed within the barrel-shaped case, and a tip mechanism with a ball positioning end and an opposite end inserted into the ink stroring tube. The tip mechanism is provided with a small metal ball and an elastic member for pressurizing the ball.

In this structure, when the pen is put on a paper, the ball is pressed and an opening path is made around the ball. At this time, ink fed to the tip mechanism from the ink storing tube flows over the ball through the opening path and is transferred onto the paper. When the pen is withdrawn from the paper, the elastic member pressurizes the ball and the opening path is closed to intercept flowing of ink.

In such a tip mechanism, a coil spring is used for the elastic member with a linearly extended ball-pressing portion which is adapted to the narrow space of an ink guide hole. The linearly extended ball-pressing portion conventionally has a diameter of 0.1~0.3 mm. Therefore, the ball-pressing portion is formed with a sharply pointed shape which is liable to intervene rotation of the ball and scratch or crack an external surface of the ball. This prevents the ball from smoothly rolling with a fluent ink flowing and causes ink spot at writing or disconnected portions at line drawing.

SUMMARY OF THE INVENTION

Accordingly, the present invention is directed to a tip mechanism for a knock-type ballpoint pen which substantially obviates one or more of the problems due to limitations and disadvantages of the related art.

An object of the present invention is to provide a tip mechanism for a knock-type ballpoint pen which can perform the ball pressurizing function with a suitably processed ball pressing part without friction loss of the ball.

To accomplish this object and other advantages, the tip mechanism for a knock type ballpoint pen with an ink container includes a tip body having an inner ink-guide hole and top and bottom end portions. The top end portion of the tip body is fitted within the ink container. A ball receptor is formed at the bottom end portion of the tip body. A ball is disposed in the ball receptor to be rotated. The ball is partially exposed to the outside. An elastic member is inserted into the ink-guide hole of the tip body. The elastic member has a ball pressing part for pressing the ball toward the outside. The ball pressing part is formed with a curved shape or a triangle or trapezoid shape. The shape of the ball pressing part is processed by bending the ball pressing part at a predetermined angle.

BRIEF DESCRIPTION OF THE DRAWINGS

The accompanying drawings, which are included to provide a further understanding of the invention and are incorporated in and constitute a part of this specification, illustrate particular embodiments of the invention and, together with the description, serve to explain the principles of the invention. In the drawings.

DETAILED DESCRIPTION OF THE INVENTION

Reference will now be made in detail to the preferred embodiments of the present invention, examples of which are illustrated in the accompanying drawings where like numerals indicate the same or similar components.

Figure 1:
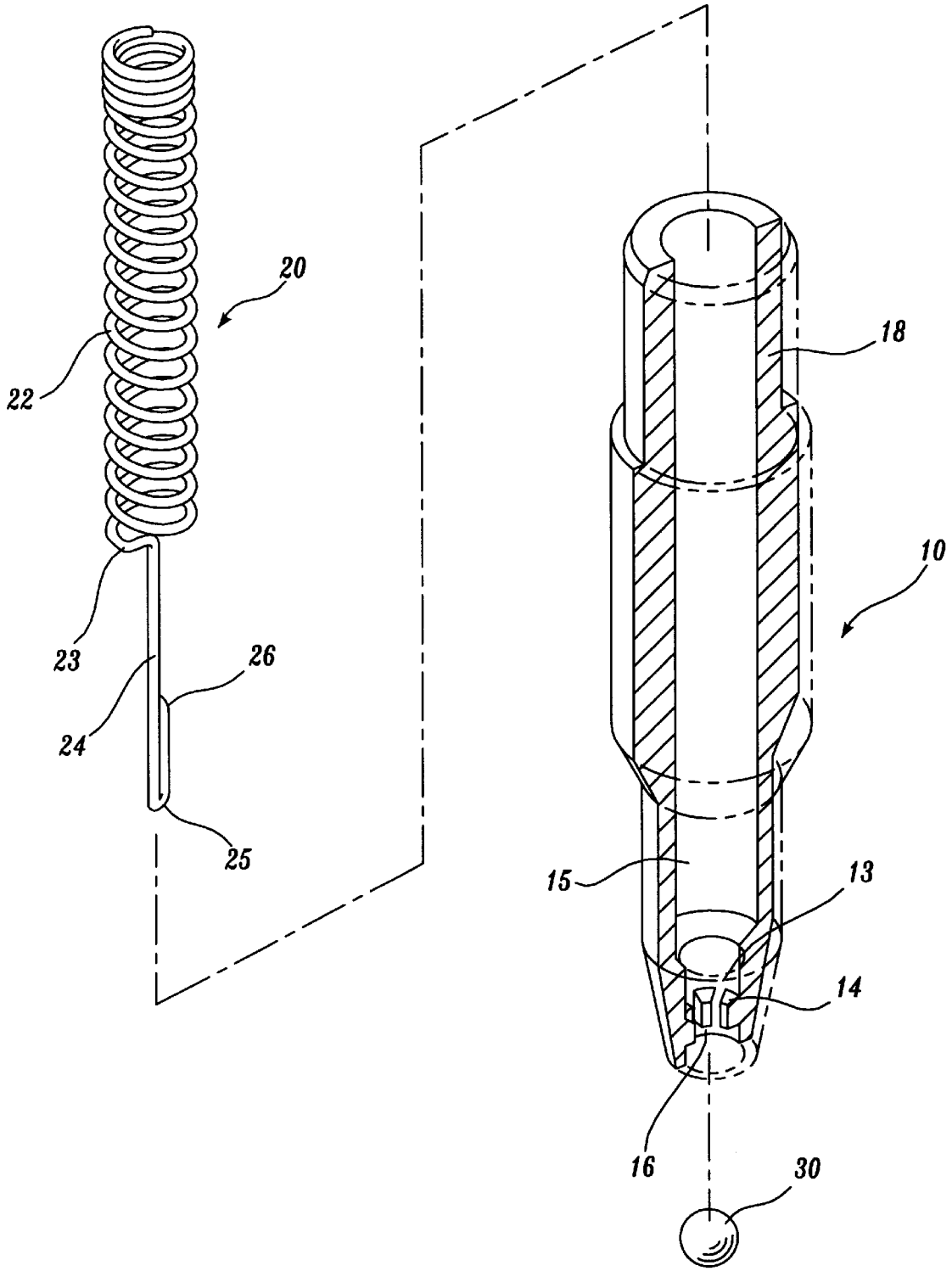
FIG. 1 is an exploded perspective view of a tip mechanism for a knock-type ballpoint pen with an elastic member according to a first preferred embodiment of the present invention.
Figure 2:
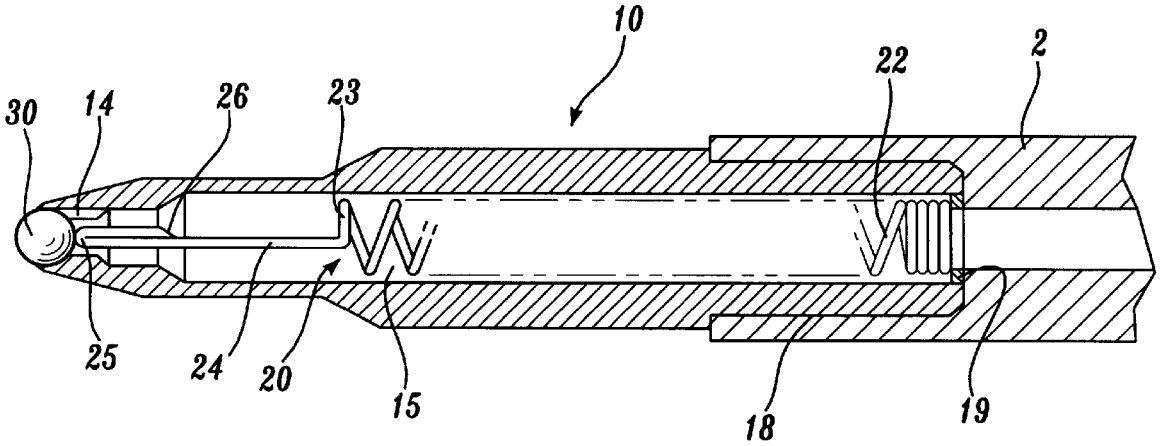
FIG. 2 is a sectional view illustrating a combinatorial state of the tip mechanism shown in FIG. 1.
Figure 3:
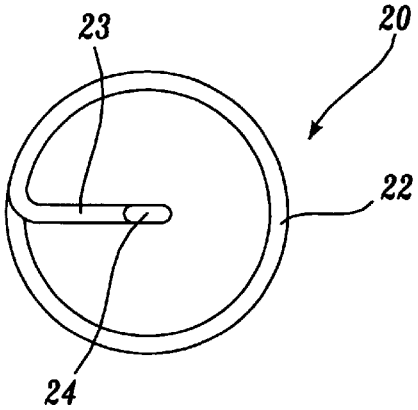
FIG. 3 is a bottom plan view of the elastic member shown in FIG. 1.

FIGS. 1 to 3 illustrate a tip mechanism for knock-type ballpoint pens according to a first preferred embodiment of the present invention.

As shown in the drawings, the tip mechanism is provided with a tip body 10 with a stepped top portion onto which an ink container 2 is partially inserted. The tip body 10 has an internal ink-guide hole 15 with a relatively narrow bottom opening portion and a relatively wide top opening portion. In this structure, the tip body 10 is outlined roughly with conical shaped inner and outer surfaces.

A ball 30 is inserted into the ink-guide hole 15 through the bottom opening portion of the tip body 10 and an elastic member 20 is inserted into the ink-guide hole 15 through the top opening portion. The bottom opening portion of the tip body 10 has a diameter smaller than that of the ball 30 such that the ball 30 once inserted into the ink-guide hole 15 does not escape therefrom. A plurality of protrusions 14 are formed at the inner surface of the tip body 10 slightly over the bottom opening portion to form a ball receptor 16 for receiving and holding the ball 30 on the one hand and to form narrow ink-guide grooves 13 on the other. It is preferable that the number of the protrusions 14 is preferably three to five. The ball receptor 16 is formed with a shape corresponding to that of the ball 30.

A fixture ring 19 is mounted at the top opening portion of the ink-guide hole 15 to keep the elastic member 20 within the ink-guide hole 15. Alternatively, the elastic member 20 may be stuck in the ink-guide hole 15 by narrowing the top opening portion or making inner protrusions at the top opening portion.

The elastic member 20 is formed with a coiling portion 22, a straight lined portion 24 and a vertically bent portion 23 interconnecting the coiling portion 22 and the straight lined portion 24. These three portions 22 to 24 are incorporated into one body.

The straight lined portion 24 has a middle side with a predetermined length and a free end side bent by 180° from the middle side. The bent position of the straight lined portion 24 forms a curved outer surface contacting the ball 30 which is referred to hereinafter as a ball pressing part with a reference numeral 25. The free end side of the straight lined portion 24 has an inclined end portion 26 which is to fluently guide flow of ink.

As shown in FIG. 2, in the combinatorial state of the tip mechanism, the ball pressing part 25 contacts the ball 30 contained in the ball receptor 16 to press it toward the bottom opening portion of the tip body 10.

In this structure, when a pen with the tip mechanism is put on the paper, the ball 30 is pressed against the paper toward the protrusions 14 and an ink outlet path is made around the ball 30. At this time, ink fed from the ink container 2 through the ink guide hole 15 and the ink guide grooves 13 flows over the ball 30 through the ink outlet path and is transferred onto the paper. When the pen is withdrawn from the paper, the ball pressing part 25 of the elastic member 20 pressurizes the ball 30 toward the bottom opening portion of the tip body 10 and the ink outlet path is closed to intercept flowing of ink.

In this operation, since the ball pressing part 25 of the elastic member 20 contacting the ball 30 is formed with a curved shape, the friction surface between the ball pressing part 25 and the ball 30 can be minimized, resulting in reduced friction loss.

Figure 4:
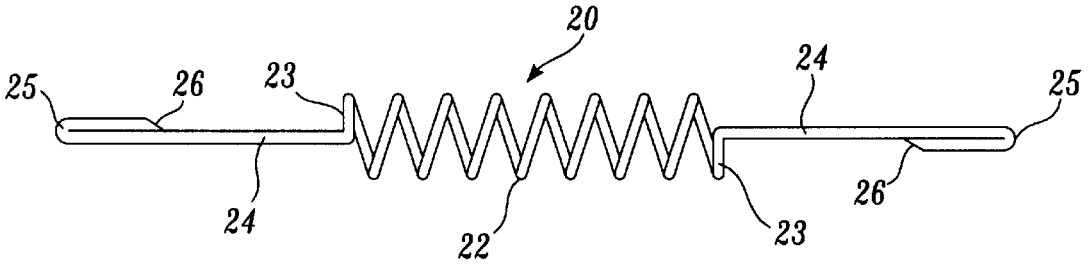
FIG. 4 is a front view of an elastic member of a tip mechanism for a knock-type ballpoint pen according to a second preferred embodiment of the present invention.
Figure 5:
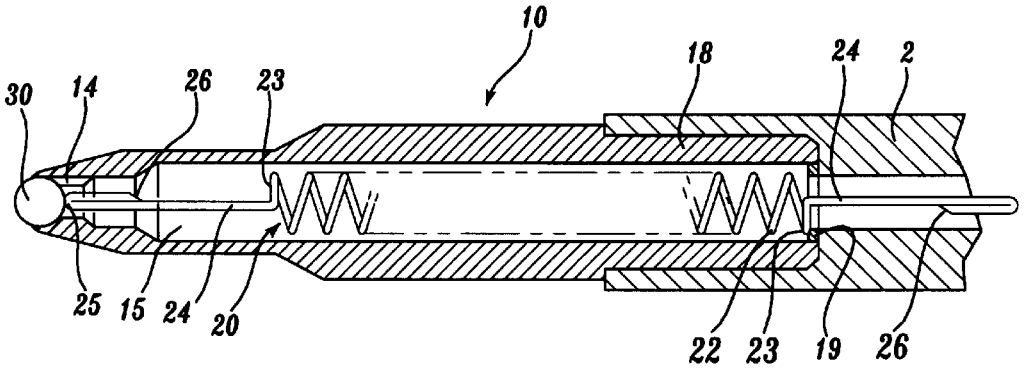
FIG. 5 is a sectional view of a tip mechanism with the elastic member shown in FIG. 4.

FIGS. 4 and 5 illustrate an elastic member of a tip mechanism for knock-type ballpoint pens according to a second preferred embodiment of the present invention. As shown in the drawings, although other components of the tip mechanism are the same as those related to the first preferred embodiment, the straight lined portion 24 of the elastic member 20 is double-sided centering the coiling portion 22. With this structure, it becomes possible to insert either side of the elastic member 20 into the ink-guide hole 15 through the top opening portion of the tip body 10. This is to consider that since the length of the elastic member 20 is extremely short, i.e., about 8~15 mm and the diameter of the coiling portion 22 is about 0.7~1.2 mm, the elastic member 20 may be reversely inserted into the ink-guide hole 15 at combination.

Figure 6:
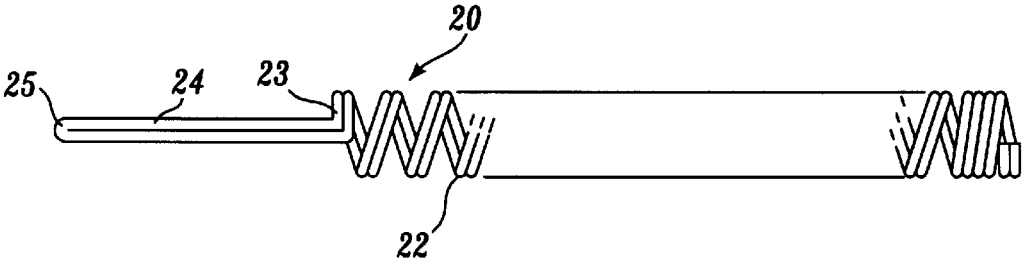
FIG. 6 is a front view of an elastic member of a tip mechanism for a knock-type ball point pen according to a third preferred embodiment of the present invention.

FIG. 6 illustrates an elastic member of a tip mechanism for knock-type ballpoint pens according to a third preferred embodiment of the present invention. As shown in FIG. 6, although other components of the tip mechanism are the same as those related to the first preferred embodiment, the elastic member 20 is structured to be formed with a double-lined coil spring which is bent at a middle portion. Therefore, the coiling portion 22, the straight lined portion 24 and the vertically bent portion 23 of the elastic member 20 are all double-lined and the straight double-lined portion 24 has a free end bent by 180° from each lined parts toward each other. The bent position of the straight double-lined portion 24 corresponds to the ball pressing part 25. In this structure, as the double-lined spring enhances strength and elasticity of the elastic member 20, it becomes possible to use a relatively short spring for the elastic member 20.

Figure 7:
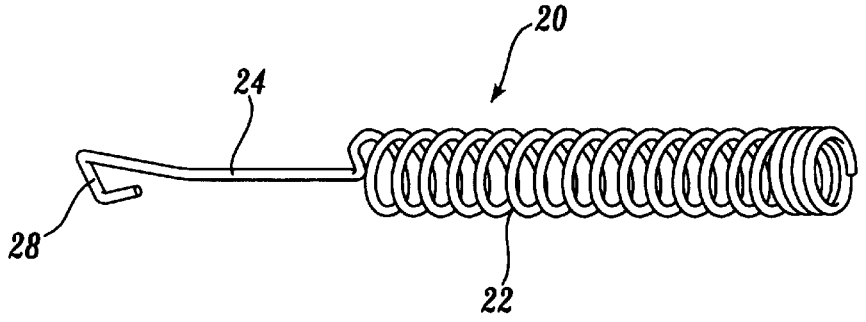
FIG. 7 is a front view of an elastic member of a tip mechanism for a knock-type ball point pen according to a fourth preferred embodiment of the present invention.
Figure 8:
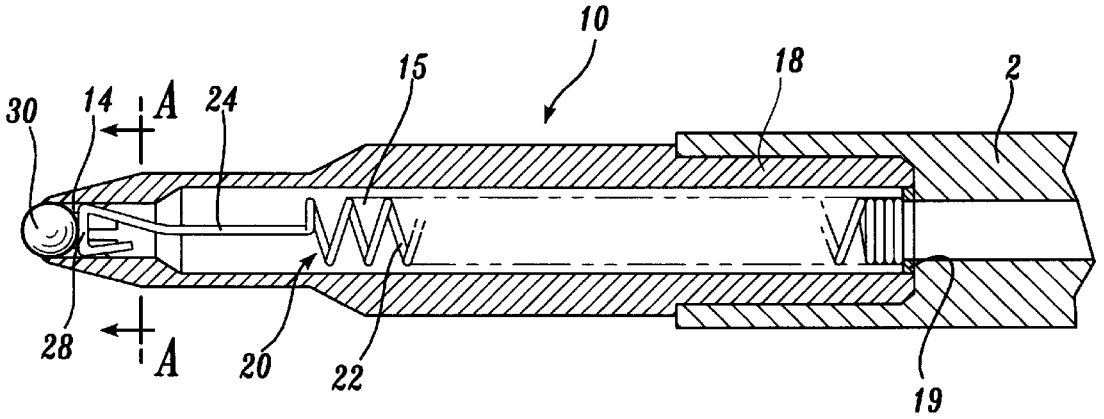
FIG. 8 is a sectional view of a tip mechanism with the elastic member shown in FIG. 7.
Figure 9:
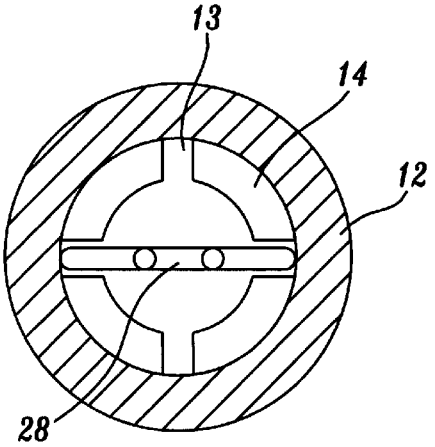
FIG. 9 is a sectional view of the tip mechanism cut along the A–A line shown in FIG. 8.

FIGS. 7 to 9 illustrate an elastic member of a tip mechanism for knock-type ballpoint pens according to a fourth preferred embodiment of the present invention. As shown in the drawings, although other components of the tip mechanism are the same as those related to the first preferred embodiment, the straight lined portion 24 is provided with a doubly bent free end part 28 for functioning as the ball pressing part 25. The doubly bent part 28 is formed with a triangle or trapezoid shape. In this structure, the doubly bent part 28 is inserted into the ink guide grooves 13 at double sides so that elastic power can be uniformly exerting for pressing the ball 30.

FIGS. 10 to 14 illustrate a tip mechanism for a knock-type ballpoint pen with a needle pipe-type tip body according to a fifth preferred embodiment of the present invention.

Figure 10:
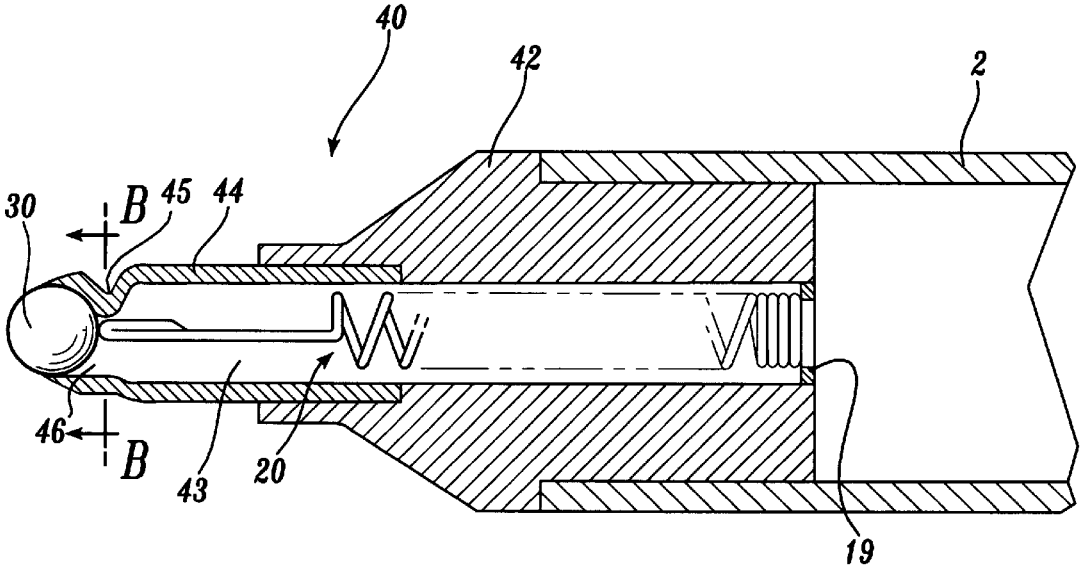
FIG. 10 is a sectional view of the tip mechanism for a knock-type ball point pen according to a fifth preferred embodiment of the present invention.
Figure 11:
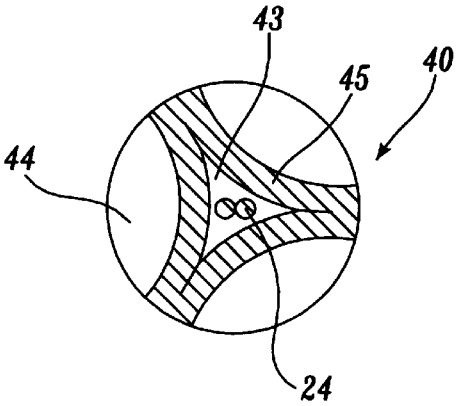
FIG. 11 is a sectional view of the tip mechanism with three protruded inner portions cut along the B—B line shown in FIG. 10.
Figure 12:
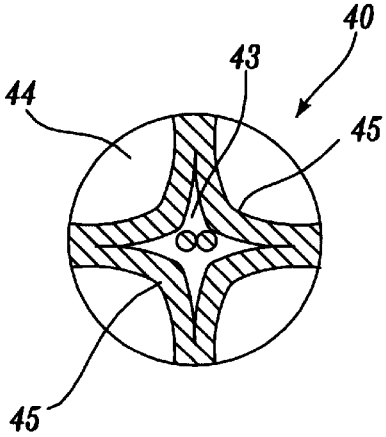
FIG. 12 is a sectional view of the tip mechanism with four protruded inner portions cut along the B—B line shown in FIG. 10.

As shown in FIGS. 10 to 12, the tip body 40 includes a connecting body 42 with a stepped portion onto which an ink container 2 is partially inserted, and a needle pipe 44 partially inserted into the connecting body 42. The connecting body 42 has an internal ink-guide hole 43 for fluid-communicating with the ink container 2. The needle pipe 44 is provided with a ball receptor 46 which is formed by a plurality of protrusions 44. The protrusions 44 are inwardly protruded by externally pressing a free end portion of the needle pipe 44.

As shown in FIGS. 11 and 12, the number of the protrusions is three or four. It is also possible that the number of the protrusions is two or, five or more.

As shown in FIG. 10, although the coil spring according to the first preferred embodiment is used for the elastic member 20, the coil springs according to the second and third preferred embodiment may be used for the same purpose.

Figure 13:
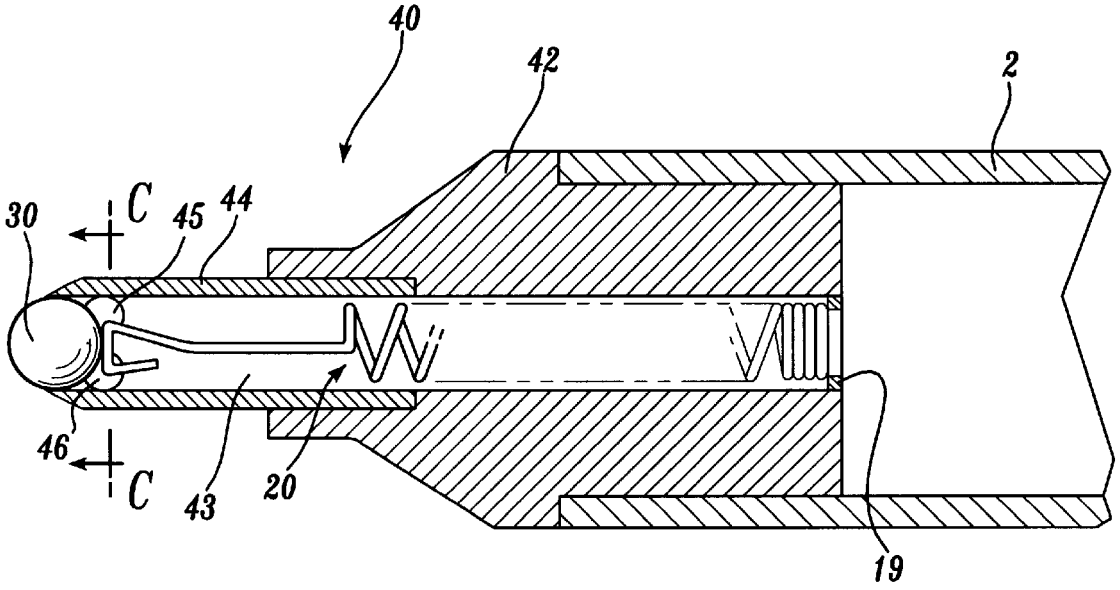
FIG. 13 is a sectional view of the tip mechanism shown in FIG. 10 using the elastic member shown in FIG. 7.
Figure 14:
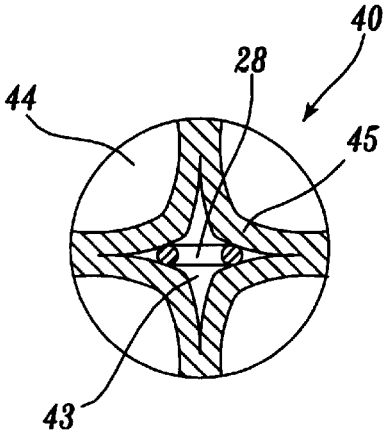
FIG. 14 is a sectional view of the tip mechanism cut along the C—C line shown in FIG. 13.

Furthermore, as shown in FIGS. 13 and 14, the coil spring according to the fourth preferred embodiment may be also used for the elastic member 20. In this case, the ball pressing part of the coil spring is inserted inbetween the protrusions 45 at double sides so that elastic power can be uniformly exerting for pressing the ball 30.

As described above, the inventive tip mechanism can perform the ball pressurizing function with the suitably processed ball pressing part without friction loss of the ball.

While the present invention has been described in detail with reference to the preferred embodiments, those skilled in the art will appreciate that various modifications and substitutions can be made thereto without departing from the spirit and scope of the present invention as set forth in the appended claims.

What is claimed is:

1. A tip mechanism for a knock type ballpoint pen having an ink container, the tip mechanism comprising:

a tip body having an inner ink-guide hole and top and bottom end portions, the top end portion of the tip body adapted for being fitted within the ink container;

a ball receptor formed at the bottom end portion of the tip body;

a ball disposed in the ball receptor, the ball being rotatable in the ball receptor and being partially exposed to the outside;

an elastic member inserted into the ink-guide hole of the tip body, the elastic member comprising a coiling portion having a top end and a bottom end, a first straight lined portion and a first vertically bent portion interconnecting the bottom end of the coiling portion and the first straight lined portion, the first straight lined portion being bent by substantially 180 degrees to form a ball pressing part with a curved shape wherein the ball pressing part directly contacts the ball.

2. The tip mechanism of claim 1 further comprising a second straight lined portion and a second vertically bent portion the second vertically bent portion interconnecting the top end of the coiling portion and the second straight lined portion.

3. The tip mechanism of claim 1 wherein the coiling portion, the first straight lined portion and the first vertically bent portion of the elastic member are all formed with a double-lined coil spring bent at a middle portion.

4. A tip mechanism for a knock type ballpoint pen having an ink container, the tip mechanism comprising:

a tip body having an inner ink-guide hole and top and bottom end portions, the top end portion of the tip body adapted for being fitted with the ink container;

a ball receptor formed at the bottom end portion of the tip body;

a ball disposed in the ball receptor, the ball being rotatable in the ball receptor and being partially exposed to the outside;

an elastic member inserted into the ink-guide hole of the tip body, the elastic member comprising a coiling portion, a straight lined portion and a vertically bent portion interconnecting the coiling portion and the straight lined portion, the straight lined portion having a ball pressing part formed by double-bending a portion of the straight lined portion into a substantially triangular shape, wherein the ball pressing part directly contacts the ball.

* * * * *